United States Patent [19]

Hall

[11] 4,174,720

[45] Nov. 20, 1979

[54] GLUE TRANSFER APPARATUS FOR CIGARETTE FILTERS

[75] Inventor: Floyd V. Hall, Durham, N.C.

[73] Assignee: Liggett Group Inc., Durham, N.C.

[21] Appl. No.: 790,949

[22] Filed: Apr. 26, 1977

[51] Int. Cl.[2] ..... A24C 5/50; A24C 5/52; A24C 1/04

[52] U.S. Cl. ..... 131/90; 131/94; 131/10.7; 131/265; 93/1 C

[58] Field of Search ..... 156/201, 202, 203; 93/1 C, 77 FT; 131/94, 24, 35, 37, 261 R, 90, 264, 91, 265, 266, 20 R, 21 R, 23 R, 29, 76, 61 R, 61 A, 65, 67, 69, 71, 76–88, 90

[56] References Cited

U.S. PATENT DOCUMENTS

| | | | |
|---|---|---|---|
| 3,482,488 | 12/1969 | Sexstone | 93/1 C |
| 3,550,508 | 12/1970 | Wartman, Jr. | 93/1 C |
| 3,762,281 | 10/1973 | Burrus et al. | 156/203 |
| 3,828,658 | 8/1974 | Brodbeck et al. | 93/1 C |

*Primary Examiner*—V. Millin

*Attorney, Agent, or Firm*—J. Bowen Ross, Jr.; Michael L. Hendershot

[57] ABSTRACT

A filter is formed by placing increments of glue in spaced apart relation on a moving stream of plug wrap paper and thereafter depositing alternating fibrous filter sections on the glue increments. Particulate marterial is then deposited between the fibrous filter sections and the plug wrap paper wrapped about the filter sections to form an endless rod. Two-filter filter plugs are severed from the rod by cutting through the unglued fibrous filter section and thereafter the charges of particulate filter material are compacted by moving the unglued outer filter sections of each plug inwardly. Each plug is then joined to two tobacco columns and cut in half. The resultant filters each have a fibrous filter section at the exposed end glued to the plug wrap paper, a compacted particulate section and an unglued fibrous filter section at the tobacco end.

8 Claims, 10 Drawing Figures

GLUE TRANSFER APPARATUS FOR CIGARETTE FILTERS

This invention relates to a glue transfer apparatus for cigarette filters. More particularly, this invention relates to a method and apparatus for forming a multi-sectional particulate containing filter. Still more particularly, this invention relates to a cavity-type filter and a cigarette made in accordance with the method.

Heretofore, various types of filters have been known for cigarettes, particularly, filters in which different types of filter media are used. For example, one type of filter which is known as a cavity-type filter constitutes two spaced apart sections of an entrainment-type filter material, such as plugs of cellulose acetate, with an intermediate section of a particulate adsorption-type filter material, such as charcoal. Generally, a cavity-type filter of this nature is made by forming a stream of cellulose acetate two into long filter rods which include a first paper wrap, cutting the rods into discrete sections, spacing the sections a desired distance apart, filling the cavities between the filter sections with charcoal and thereafter wrapping a continuous length of heat-sealing plug wrap paper about the charcoal and filter sections to form an endless rod. Thereafter, this rod is passed through a heating device to melt the heat-sealing resin on the heat-sealing paper in order to bond the plug wrap paper to the filter sections. The rod is then cut into lengths sufficient to form a number of filters, e.g. six filters. These lengths are thereafter severed to form a double filter plug for delivery to a cigarette making machine.

Generally, the charcoal which is enclosed in these filters does not completely fill the spaces between the cellulose acetate sections. Because this may result in a less efficient filter, efforts have been made to exert axial compaction forces on the filter plugs after fabrication so as to force the cellulose acetate plugs inwardly and, thus, reduce the size of the spaces in which the charcoal is located, for example as described in U.S. Pat. Nos. 3,715,957 and 3,354,887. For this purpose, each dual filter plug, immediately prior to entering a cigarette making machine, is passed through a charcoal cavity compactor. Usually, these compactors have axially aligned plungers which are arranged to move toward each other to push the outer filter sections into the charcoal cavity.

However, it has been found that compaction of the charcoal cavity is not readily obtained if the heat sealing portion of the plug wrap paper fully adheres to the filter sections. That is because the outer filter sections are sufficiently bound to the plug wrap paper so as to resist the force of the plungers and, thus, are prevented from being pushed into the charcoal cavity. As a result, the charcoal remains uncompacted with the charcoal being free to rattle around in the resultant cigarette. In some instances, it has been found that the charcoal occupies only 62½% of the charcoal cavity. Thus, certain portions of the cigarette smoke entering a smoker's mouth may have passed through the charcoal cavity without coming into contact with the charcoal.

Further, if the heat sealed portion of the plug wrap paper is not readily activated, the fibrous filter section on the smoker's end of the cigarette can actually be drawn out of the filter during smoking since there is nothing to prevent the section from being retained in place.

A further disadvantage of heat sealing is that if a filter rod is allowed to stand in a heated chamber, both paper and filter begin to char in a relatively short time. This is due to the fact that the heat chamber must be at a high temperature in order to accommodate the high linear speed of the endless filter rod and to activate the heat seal portion of the plug wrap paper.

Furthermore, paper with a heat sealing portion is approximately twice as expensive and occupies twice the volume per linear unit as does paper without a heat sealing portion thereon.

Accordingly, it is an object of this invention to reduce the cost of manufacturing cavity-type filters for cigarettes.

It is another object of the invention to provide a simplified structure for manufacturing cavity-type filters.

It is another object of the invention to eliminate the need for using plug wrap paper of heat-sealing type in making cavity-type filters.

It is another object of the invention to provide a relatively simple manner of effecting compaction of particulate material within a cavity of a cavity-type filter.

It is another object of the invention to avoid the need for heat sealing in making endless filter rods.

Briefly, the invention provides a method and apparatus for forming a multi-sectional particulate-containing filter of the cavity type.

The method employs the steps of moving a stream of plug wrap paper through a predetermined path, placing increments of glue on one side of the stream at predetermined spacings from each other, moving a sequence of fibrous filter sections onto the stream of plug wrap paper with alternate fibrous filter sections disposed on the increments of glue and in spaced relation, depositing charges of particulate material between the fibrous filter sections and, thereafter, wrapping the stream of plug wrap paper about the filter sections to form an endless rod. The rod is then severed into filter plugs of predetermined length with each plug having three fibrous filter sections and two particulate filter material sections with the intermediate fibrous filter section glued to the plug wrap paper.

Thereafter, the outer fibrous filter sections of each filter plug are moved inwardly towards the intermediate fibrous filter section in order to compact the charges of particulate filter material. The filter plug is then joined with a tobacco column at each end and severed in half to form two cigarettes each of which has a filter section at the exposed end glued to the plug wrap paper, an unglued filter section at the opposite tobacco column end and a compacted charge of particulate filter material therebetween.

The apparatus of the invention includes a conveyor for moving a stream of plug wrap paper through a predetermined path; means for placing increments of glue on one side of the stream of plug wrap paper at predetermined spacings from each other, means for moving a sequence of fibrous filter sections onto the moving stream of plug wrap paper with alternate filter sections disposed on the increments of glue, means for depositing charges of particulate filter material between the fibrous filter sections and means for wrapping the moving stream of plug wrap paper about the filter sections to form an endless rod.

In one embodiment, the means for placing the glue on the plug wrap paper is in the form of a glue transfer apparatus having a transfer roll with a plurality of spaced apart flats in a circumferential surface for receiving glue and for subsequently placing the glue on the stream of plug wrap paper in a spaced array. In order to deliver glue to the flat-containing transfer roll, the transfer apparatus has a gluepot which contains a reservoir of glue and a rotatable glue transfer roll which has a circumferential surface projecting into the glue pot to transfer glue from the reservoir into the flats of the flat-containing transfer roll. In addition, the transfer apparatus has a third roll rotatably mounted adjacent to the flat-containing transfer roll to define a nip for passage of the stream of plug wrap paper. During passage of the plug wrap paper through the nip, the flat-containing transfer roll places increments of glue on the paper in spaced relation corresponding to the flats.

In another embodiment, the means for placing the glue on the plug wrap paper is in the form of a glue transfer apparatus which includes a rotatable transfer roll spaced from the path of the plug wrap paper and a rotatable roll having a plurality of radial spokes which periodically deflects the stream of plug wrap paper about the transfer roll to place increments of glue on the plug wrap paper stream in spaced relation. As above, in order to deliver glue to the transfer roll, the transfer apparatus employs a glue pot and a rotatable glue transfer roll which projects into the glue pot. This latter transfer roll also has a circumferential groove in the surface to receive the glue.

In this embodiment, when the plug wrap paper stream passes between the upper transfer roll and the spoked roll, the spokes of the spoked roll periodically deflect the paper stream about the upper transfer roll. This allows the transfer roll to place increments of glue on the paper stream in spaced relation. Since the plug wrap paper stream only periodically contacts the glue transfer roll, the glue transfer roll need not rotate at the same speed as the plug wrap paper stream. Thus, the glue transfer rolls are rotated at a slower speed than the paper stream and the spoked roll.

In order to deflect the paper stream about the glue transfer roll, the axis of the spoked roller is offset from the plane of the axes of the two glue transfer rolls in a direction downstream of the transfer rolls relative to the direction of movement of the paper stream. This allows each spoke to project below the top of the upper glue transfer roll when deflecting the moving paper stream so as to cause a segment of the paper stream to deflect about the transfer roll. Due to the difference in speed between the paper stream and the transfer roll, the paper slides on the transfer roll and picks up a segment of glue, i.e. by a wiping action. As a spoke moves away from the transfer roll, the paper stream likewise moves away from the transfer roll while advancing. When the next spoke deflects the paper stream a fresh segment of paper is moved against the transfer roll to receive another segment of glue.

The apparatus also includes a compacting means for moving the outer filter sections of each filter plug which is severed from the endless rod inwardly towards the intermediate filter section in order to compact the charges of particulate filter material therebetween. This apparatus may be of the type as described in U.S. Pat. Nos. 3,719,957 and 3,354,887.

The invention further provides a filter plug which comprises three fibrous filter sections, two sections of particulate filter material arranged in alternation with the fibrous filter sections, a strip of plug wrap paper about the filter sections and a layer of glue securing the intermediate fibrous filter section to the strip of plug wrap paper with the remaining fibrous filter sections being unglued to the strip of plug wrap paper. Similarly, the filter provided by the invention comprises a pair of fibrous filter sections, a compacted particulate filter section between the fibrous filter sections, a strip of plug wrap paper about the filter sections and a layer of glue securing one of the fibrous filter sections to the strip of plug wrap paper with the other fibrous filter section being unglued to and recessed in the strip of plug wrap paper.

The filter cigarette which is formed in accordance with the invention comprises a tobacco column, a filter, as above, with a recessed end adjacent the tobacco column and a layer of tipping paper joining the tobacco column and filter together.

These and other objects and advantages of the invention will become more apparent from the following detailed description and appended claims taken in conjunction with the accompanying drawings in which:

FIG. 3 illustrates a schematic view of a continuous stream of plug wrap paper having increments of glue and alternating fibrous filter sections thereon in accordance with the invention;

Figure 1:
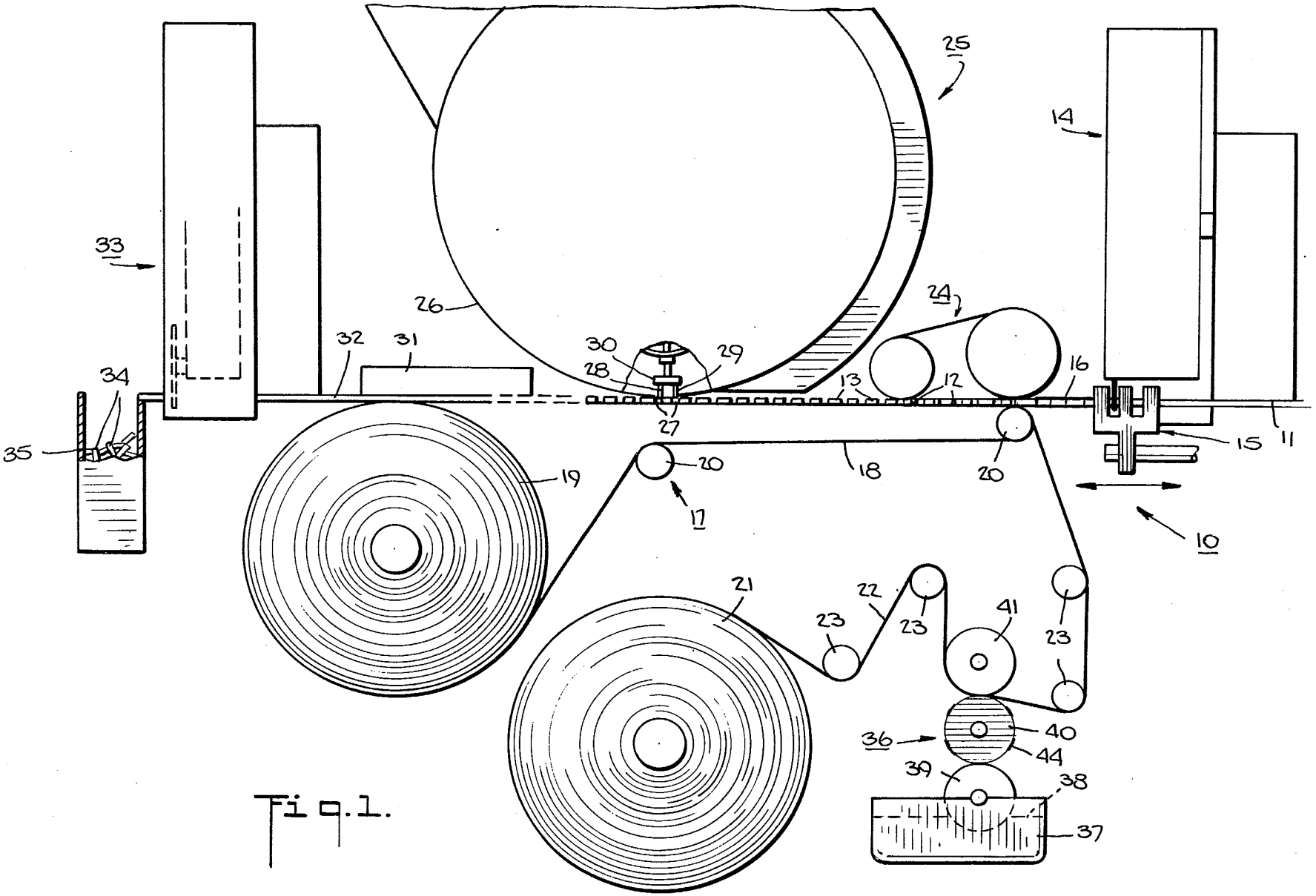
FIG. 1 illustrates a schematic view of a filter rod making apparatus employing a glue transfer apparatus in accordance with the invention.

Referring to FIG. 1, an apparatus 10 for making a filter rod is supplied with a continuous rod 11 of entrainment-type filter material, such as cellulose acetate (tow), which is severed into discrete filter sections or plugs 12, 13 of different lengths by a knife assembly 14 such as described in U.S. patent application Ser. No. 769,968 filed Feb. 18, 1977 now U.S. Pat. No. 4,063,494. The knife assembly 14 cooperates with a reciprocating recessed ledger 15 through which the rod 11 passes so that the severed plugs 12, 13 can be held after being severed and then passed into the remainder of the rod-making apparatus 10. To this end, the ledger 15 has a guide tube 16 in which a number of plugs are located and from which the plugs are ejected individually.

The rod-making apparatus 10 has a conveyor 17 disposed adjacent to the outlet of the guide tube 16 of the ledger 15 to receive the plugs 12, 13. The conveyor 17 includes an endless belt 18 which is driven by a drive roll 19 over suitable guide rolls 20 in known manner. In addition, a supply roll 21 of plug wrap paper 22 is mounted below the conveyor 17 with suitable guide rolls 23 positioned to guide the paper 22 onto the conveyor belt 18 at a point below the guide tube 16 of the ledger 15. In this way, the discrete filter plugs 12, 13 are deposited directly from the guide tube 16 onto a stream of plug wrap paper 22 in spaced apart relation in known manner. For example, the plugs 12, 13 are spaced apart a distance of six millimeters (6 mm). The ledger 15 and guide tube 15 thus serve as a means for placing a sequence of spaced apart filter sections 12, 13 onto the moving stream of plug wrap paper 22.

As shown in FIG. 1, a suitable hold down means 24 may be located above the conveyor 17 to hold the plugs 12, 13 on the moving stream of paper 22 and the conveyor belt 18.

Referring to FIG. 1, the apparatus 10 also employs a means 25 for depositing charges of particulate filter material, such as charcoal, onto the moving stream of plug wrap paper 22 between the adjacent filter sections 12, 13. As indicated, this means 25 is in the form of a rotatable charcoal wheel 26 of known construction wherein pairs of charges 27 of charcoal are injected between the filter sections 12, 13. For this purpose, the charcoal wheel 26 has peripherally spaced chambers 28 which are spaced to coincide with the spaces between the filter sections 12, 13 travelling on the stream of plug wrap paper 22 and a plunger 29 in each chamber 28 which expels a charge of charcoal 27 via a reciprocating hammer 30 or a cam as is known.

Figure 4:
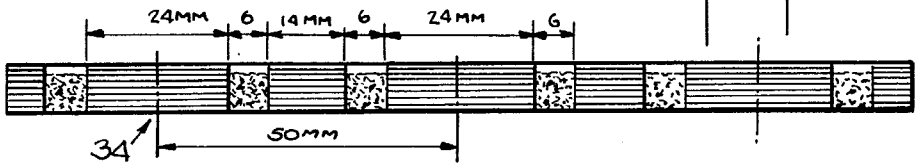
FIG. 4 illustrates a cross sectional view of a multiple filter plug initially severed from an endless rod made in accordance with the invention.
Figure 9:
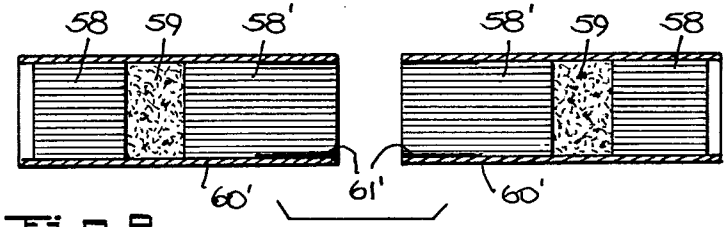

The apparatus 10 also employs a garniture section 31 of known construction for wrapping the moving stream of plug wrap paper 22 about the filter sections 12, 13 and charges 27 of charcoal in order to form an endless rod 32. As shown, the garniture section 31 is spaced immediately downstream of the charcoal wheel 26. In addition, the apparatus 10 has a knife 33 for severing the endless rod 32 into filter plugs 34 of multiple filter length. As shown in FIG. 4, each plug 34 may be of a six filter unit having alternating sections 12, 13 of fibrous filter material and charcoal with a cut being made through the shorter length sections 12. These plugs 34 are deposited in a catcher 35 or other suitable means for further processing on a cigarette making machine (not shown).

Figure 2:
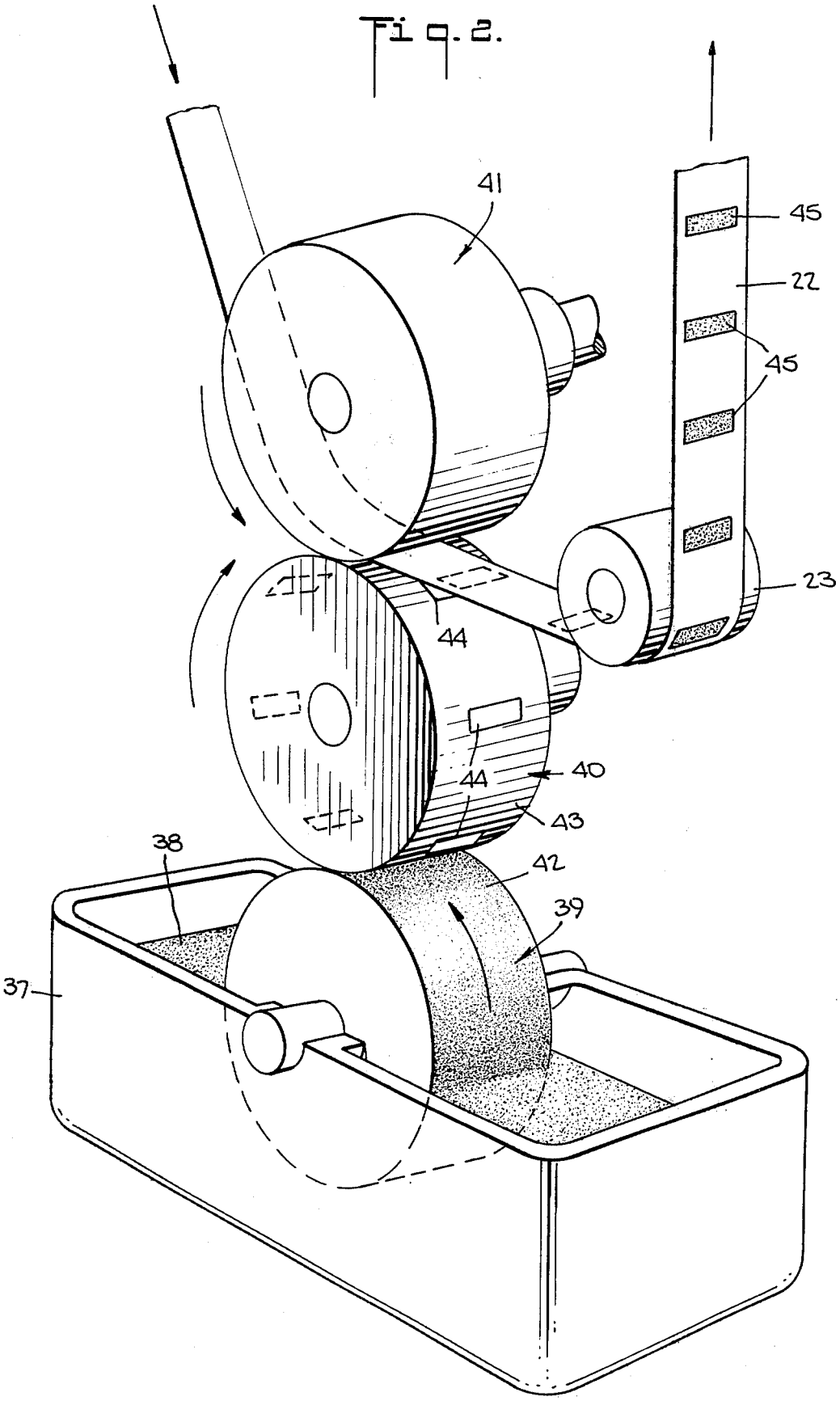
FIG. 2 illustrates a perspective view of a glue transfer apparatus in accordance with the invention.

Referring to FIG. 1, a means such as glue transfer apparatus 36 is positioned in the path of the stream of plug wrap paper 22 for placing increments of glue on one side of the stream at predetermined spaces. As shown in FIG. 2, the glue transfer apparatus 36 includes a glue pot 37 containing a reservoir of glue 38 and a plurality of vertically aligned rolls 39, 40, 41. The lowermost roll 39 is rotatably mounted on the glue pot 37 to function as a transfer roll and has a circumferential surface 42 which projects into the pot 37 to pick up a layer of glue during rotation. The next roll 40 is also a transfer roll and has a circumferential surface 43 facing and pressed against the surface 42 of the lowermost roll 39, for example under a force of fifteen pounds per linear inch between rolls. In addition, this circumferential surface 43 has a plurality of circumferentially spaced flats 44, e.g. six to receive glue from the roll 39. The third roll 41 is rotatably mounted above the flat-containing transfer roll 40 to define a nip for passage of the stream of plug wrap paper 22. The roll 41 is also knurled to provide an effective drive surface against which the plug paper 22 can be driven.

Referring to FIG. 2, the flats 44 on the transfer roll 40 are each of a size so as to deposit an increment of glue 45 of the same size on the plug wrap paper 22. For example, for a transfer roll 40 of three hundred millimeters (300 mm) circumference, and for filter sections 12, 13 of alternating sizes of fourteen millimeters (14 mm) and twenty-four millimeters (24 mm) with an intervening space of six millimeters (6 mm) the flats are spaced 60° apart, i.e. fifty millimeters (50 mm) apart, and each flat is of a circumferential length of twelve millimeters (12 mm) and a width of twenty-two millimeters (22 mm). In addition, each flat 44 is slightly recessed in the transfer roll 40, for example by 0.01 millimeters in order to pick up the glue 38 from the transfer roll 39. The clear spacing between the flats 44 is thus thirty-eight millimeters (38 mm).

The three rolls 39, 40, 41 are each driven in synchronism with respect to the knife assembly 14 and knife 33 so as to deposit the increments of glue 45 on the paper 22 at places corresponding to the positions of the longer filter sections 13. In this way, only the longer filter sections 13 are glued to the plug wrap paper 22 whereas the shorter filter sections 12 remain unglued relative to the plug wrap paper 22.

During passage of the plug wrap paper 22 through the nip defined by the two upper rolls 40, 41, the flat-containing roll 40, which has received glue within the flats 44 from the roll 39 on the glue pot 37, transfers the glue onto the plug wrap paper 22 in spaced increments 45. The plug wrap paper 22 is then conveyed over the guide rolls 23 to the conveyor 17 for fabrication of the filter plugs 34.

Referring to FIG. 4, the rotation of the flat-containing transfer roll 40 is timed to both the speed of the knife assembly 14 and the knife for severing the endless rod into the filter plugs. Thus, any change in speed of the filter rod making apparatus 10 automatically adjusts the glue transfer apparatus 36 to the new speed.

Figure 5:
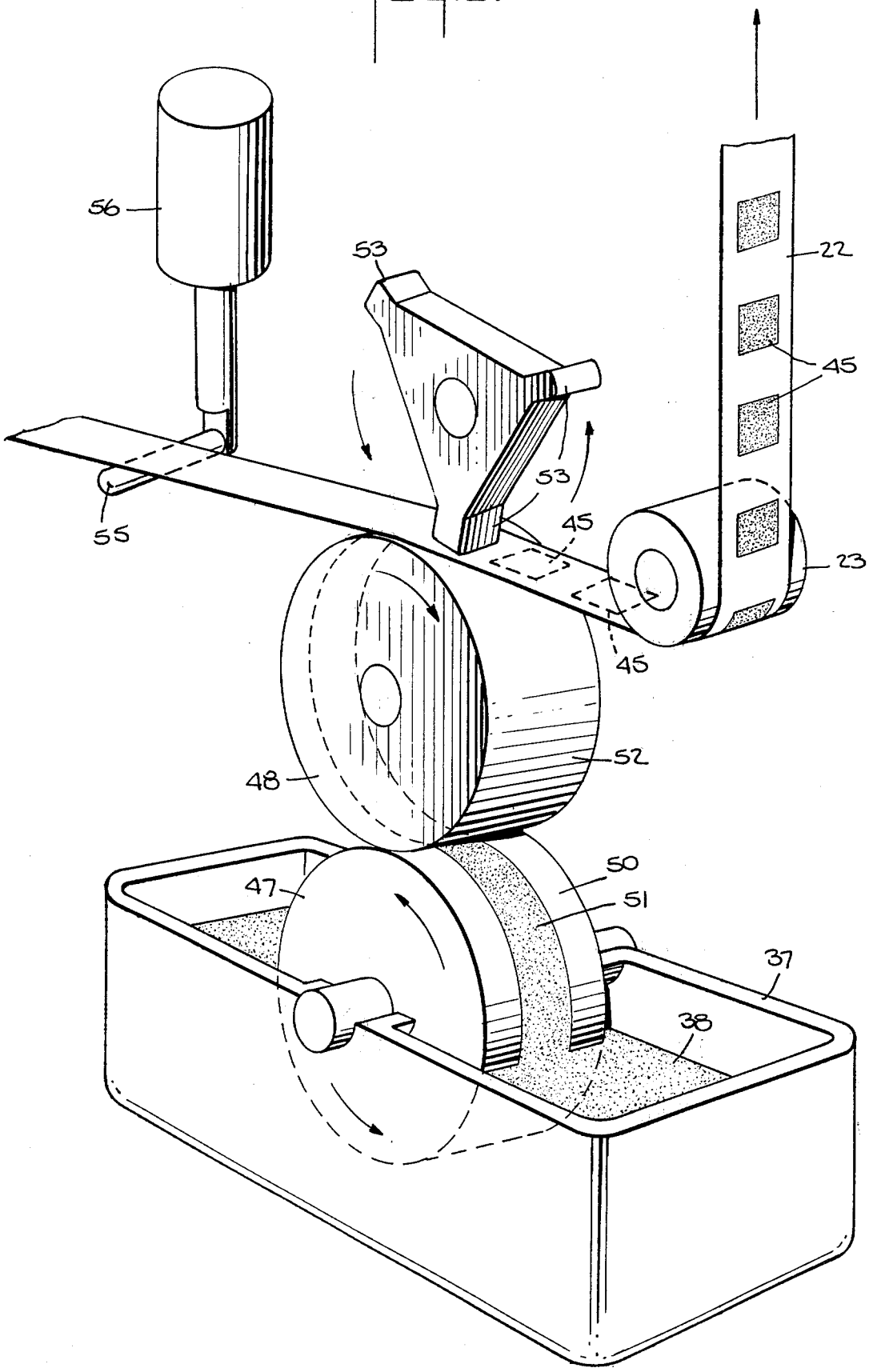
FIG. 5 illustrates a perspective view of a further means for placing glue on the plug wrap paper.
Figure 6:
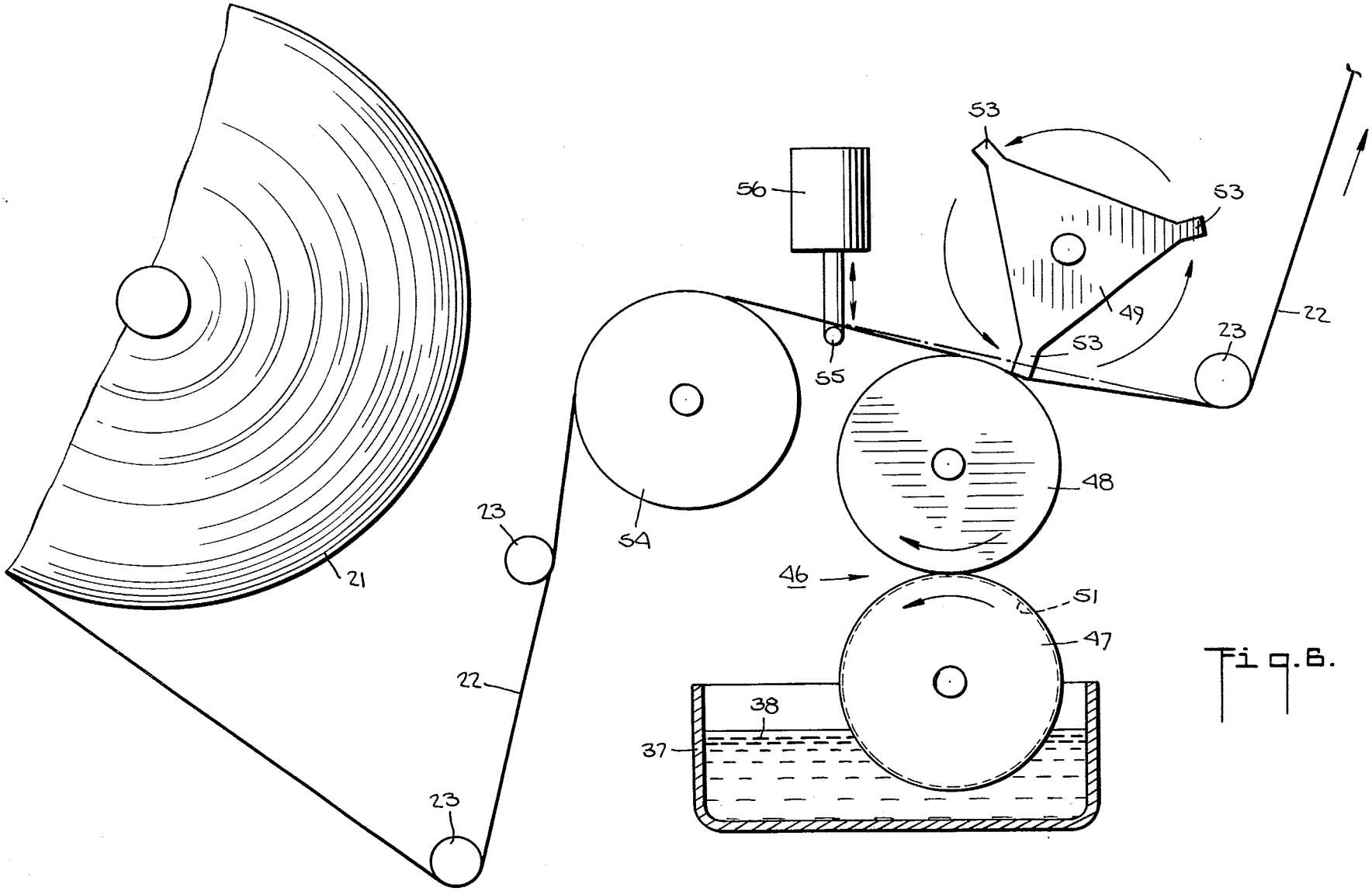
FIG. 6 illustrates a side view of the glue placing means of FIG. 5.

Referring to FIGS. 5 and 6, wherein like reference characters indicate like parts as above, the means for placing the increments of glue may be of other construction. To this end, the glue transfer apparatus 46 includes a glue pot 37 containing a reservoir of glue 38 as above. In addition, the glue transfer apparatus 46 includes three rolls 47, 48, 49. The lowermost roll 47 is rotatably mounted on the glue pot 37 to function as a transfer roll and has a circumferential surface 50 which projects into the pot 37 to pick up a layer of glue during rotation. In addition, the roll 47 has a circumferential groove 51 in the surface 50. This groove 51 is about three (3) mils deep to receive the glue from the glue pot 37. The next roll 48 is also a transfer roll and has a smooth circumferential surface 52 which receives a strip of glue from the groove 51 in the lower transfer roll 47 and which is spaced below the path of the stream of plug wrap paper 22. These two glue transfer rolls 47, 48 are disposed on respective axes which are located in a common plane, i.e. a vertical plane. The third roll 49 is provided with a plurality of radial spokes 53, for example of a width of eighteen (18) millimeters and a thickness of three-sixteenths (3/16) inches with a rounded surface.

As shown in FIG. 6, the spoked roll 49 is disposed on an axis displaced from the plane of the two glue transfer rolls 47, 48 downstream of the glue transfer rolls 47, 48 relative to the direction of movement of the plug wrap paper stream 22. In addition, the spoked roll 49 is positioned so that the spokes 53 pass through the normal path of the plug wrap paper stream 22 to periodically deflect the plug wrap paper 22 about the transfer roll 48. For this purpose, the spoked roll 49 is positioned relative to the transfer rolls 47, 48 so as to have each spoke, in turn, pass below the uppermost horizontal plane of the upper transfer roll 48 as shown in FIG. 6. The spoked roll 49 is timed to the knife assembly (FIG. 1) so that each spoke 53 causes an increment of glue 45 to be placed on the plug wrap paper 22 at a point to receive a filter plug 13.

Referring to FIG. 6, a drag roller 54 is positioned in the path of the plug wrap paper stream 22 upstream of the glue transfer apparatus 46 so that the paper stream 22 moves about the drag roller 54. The drag roller 54 rotates at a speed slightly faster than the conveyor belt of the garniture 31 (FIG. 1) so as to ensure a constant tension in the paper 22. This aids in pulling the paper from the supply roller 21.

Referring to FIGS. 5 and 6, a pin or roller 55 is disposed between the drag roller 54 and the glue transfer roller 48. This pin 55 is positioned below the stream of paper 22 and is mounted to reciprocate in a vertical plane via a suitable solenoid 56 for purposes as described below.

The spoked roller 49 is continuously rotatable at the speed of the apparatus 10 and is timed to the knife assembly 14 whereas the glue transfer rolls 47, 48 rotate at a slower continuous speed. For example, the spoked roller 49 rotates at a speed 2½ times the speed of the glue transfer rolls 47, 48.

In operation, as the paper stream 22 moves through the normal path between the drag roller 54 and guide rolls 23' (FIG. 6) the paper 22 is spaced from the upper transfer roll 48. At this time, glue cannot be transferred from the roll 48 to the paper 22. However, as a spoke 53 of the spoked roll 49 moves into the position as shown in FIG. 6, the spoke 53 deflects the paper 22 from the normal path about the upper surface of the transfer roll 48. At this time, a small segment of the paper 22 is placed in contact with the glue on the roller 48 behind the spoke 53. As the spoke 53 moves away, the paper stream 22 lifts from the transfer roll 48 and returns to the normal path while picking up an increment of glue 45 from the transfer roll 48. For example, each increment of glue which is picked up from the transfer roll 48 is of a length longitudinally of the paper stream 22 of twenty (20) millimeters and a width of eighteen (18) millimeters.

Upon coming into contact with the transfer roll 48, the paper 22 is pressed against the strip of glue on the roll 48 and then slides along the roll 48 due to the difference in speed therebetween. This sliding action, in effect, causes the paper to wipe a segment of glue 45 from the roll 48. Also, the subsequent lifting and deflecting of the paper 22 relative to the roll 48 effects a positive means of assuring a clean separation between successive increments of glue 45.

Since the paper stream 22 is only in periodic contact with the glue transfer roll 48, the speed of the transfer roll 48 may be significantly reduced relative to the speed of the spoked roll 49. In this way, splashing of glue off the glue transfer rolls 47, 48 can be significantly reduced while assuring that only spaced segments of glue 45 are picked up by the plug wrap paper 22.

When the apparatus 10 is started the pin 55 is lowered via the solenoid 56 below the path of the plug wrap paper 22. In this position, the pin 55 is out of contact with the paper stream 22. However, should operation of the apparatus 10 cease, the pin 55 is immediately raised via the solenoid 56 so as to lift the paper stream 22 away from the glue transfer roll 48. This ensures that the paper 22 does not adhere to the transfer roll 48.

After the increments of glue 45 are placed on the plug wrap paper 22, the paper stream is passed to the conveyor 17 (FIG. 1) where operation continues as for the embodiment described in FIGS. 1 to 2.

Figure 7:
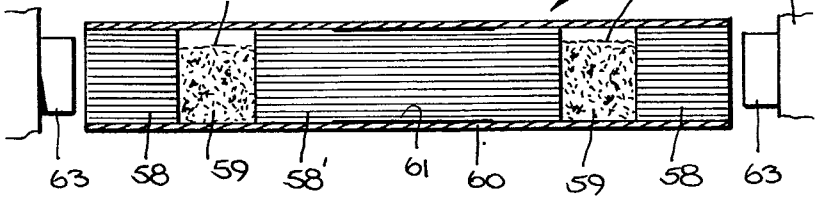
FIG. 7 illustrates a dual filter plug severed from the filter plug of FIG. 4 in accordance with the invention prior to compaction.
Figure 8:
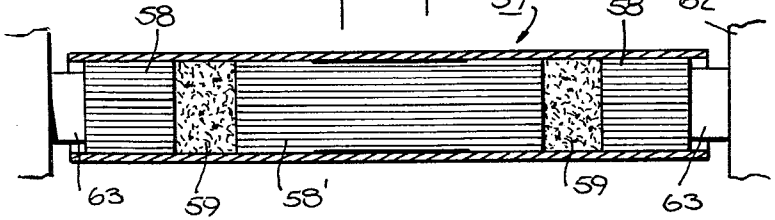
FIG. 8 illustrates the filter plug of FIG. 7 after compaction.

Referring to FIG. 1, after fabrication, the filter plugs 34 are supplied to a cigarette making machine (not shown) via suitable transfer and alignment drums (not shown) wherein the plugs 34 are severed into dual filter plugs 57 for example as shown in FIG. 7. This is accomplished by cutting through the shorter length filter sections 12 such that the resultant dual filter plug 57 has three fibrous filter sections 50, 50' and two particulate filter material sections 59 arranged in alternating fashion within a layer of plug wrap paper 60 with a layer of glue 61 adhering the intermediate filter sections 58', to the plug wrap paper 60. While on the transfer drum, each dual filter plug 57 is compacted by a compacting means 62 via axially movable plungers 63 such as described in U.S. Pat. No. 3,715,957. The plungers 63 of the compacting means 62 are moved as indicated in FIG. 8 so as to push the outer filter sections 58, 58' of each plug 57 inwardly of the layer of plug wrap paper 60 towards the intermediate section 58' so as to compact the charges of charcoal 27 in the sections 59. Since the outer filter sections 58 are not glued to the layer of plug wrap paper 60, these sections 58 slide relative to the plug wrap paper layer 60 under the force of the plungers 62. As a result, the charges of charcoal 27 are compacted so as to completely fill the space between the adjacent filter sections 58.

Figure 9:
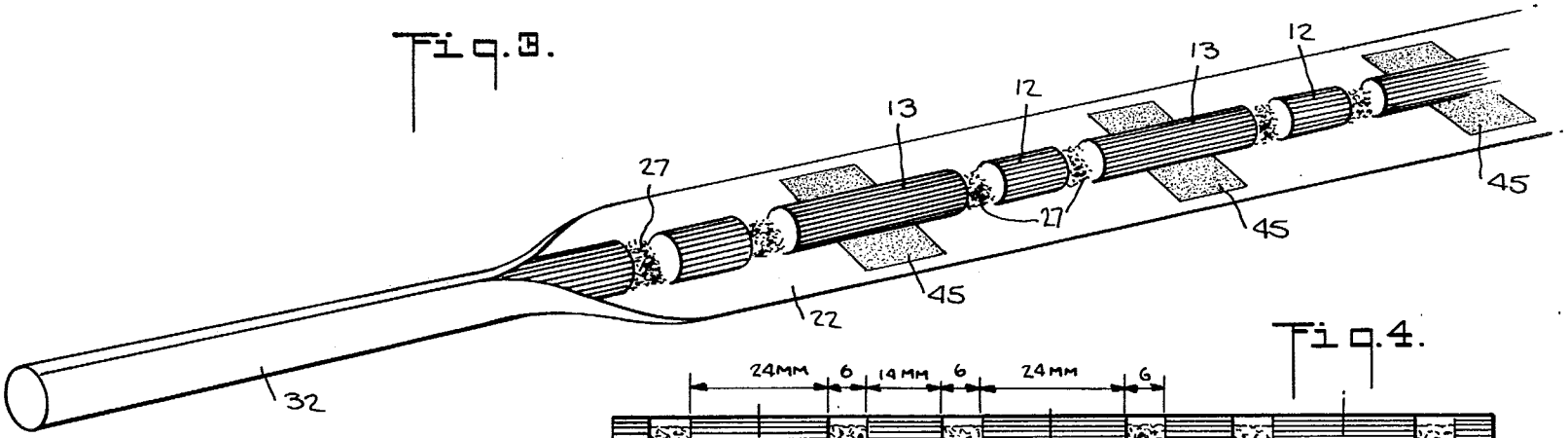
FIG. 9 illustrates the filter plug of FIG. 8 severed in half.
Figure 10:
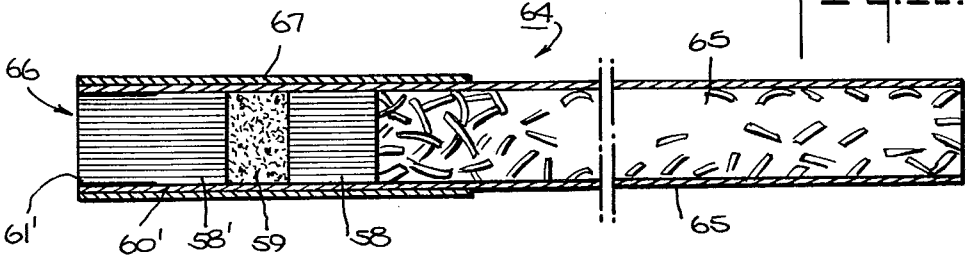
FIG. 10 illustrates a filter cigarette made with a filter in accordance with the inventiion.

After compacting, each plug 57 is placed between two tobacco columns, as is known, in the cigarette making machine and a strip of tipping paper is then wrapped about and adhered to the filter plug 57 and tobacco columns to secure the tobacco columns to the filter plug. Thereafter, this assembly is severed through the midpoint of the filter plug 57 as indicated in FIG. 9 to form two cigarettes. As shown in FIG. 10, each cigarette 64 thus includes a tobacco column 65, a filter 66 which abuts the tobacco column 65 and a layer of tipping paper 67 which joins the tobacco column 65 and filter together. The filter 66 has a pair of fibrous filter sections 58, 58' a charcoal filter section 59 between the fibrous filter sections 57, 57'' and a strip of plug wrap paper 60' about the filter sections. Also, a layer of glue 60' secures the fibrous filter section 58'' remote from the tobacco column 65 to the strip of plug wrap paper 60' while the other fibrous filter section 58 is recessed into the strip of plug wrap paper 60' and is unsecured thereto. Thus, the exposed end of the cigarette 64 shows a flush appearance while the charcoal section 59 is completely compacted.

Referring to FIG. 4, each filter plug 34 which is severed from the endless rod 32 has a foremost and rearmost fibrous filter section of a length of six millimeters with interior filter sections of length of twenty four millimeters (24 mm) and fourteen millimeters (14 mm), respectively. These fibrous filter sections are spaced apart by a particulate filter section of six millimeters (6 mm). The dual filter plug 57 which are cut from this filter plug 34 (see FIG. 7) has two end fibrous filter sections of a length of seven millimeters, an intermediate fibrous filter section of a length of twenty-four millimeters (24 mm) and a charcoal section of six millimeters (6 mm) in length. The resultant filter has a fibrous filter section 58 at the exposed end of twelve millimeters (12 mm) and a charcoal section 59 of somewhat less than six millimeters (6 mm).

The invention thus provides a means of making cavity-type filters which does not require heat sealing paper nor a heat seal assembly. As a result, the need to provide expensive heat seal paper is avoided and the overall cost of materials for making the filters can be reduced. In addition, since the apparatus does not require a heat sealer, the apparatus can be simplified and the problems attendant with charing caused by a heat sealer eliminated.

The invention further provides a filter cigarette employing a cavity-type filter wherein the filter material at the exposed end of the cigarette is firmly held in place.

The invention further provides an apparatus and method of efficiently compacting particulate material within cavity-type filters without destroying the integrity of the filters.

What is claimed is:

1. A method of forming a multi-sectional particulate-containing filter, said method comprising the steps of moving a stream of plug wrap paper through a predetermined path;

placing increments of glue on one side of the stream of plug wrap paper at predetermined spacings from each other;

moving a sequence of spaced apart filter sections onto the moving stream of plug wrap paper with alternate filter sections being disposed on the increments of glue;

subsequently depositing charges of particulate filter material onto the moving stream of plug wrap paper between adjacent filter sections;

thereafter wrapping the moving stream of plug wrap paper about the filter sections and charges of particulate filter material to form an endless rod;

severing the endless rod at each of said filter sections into a filter plug, said filter plug having a charge of particulate material flanked by severed filter sections with one of said filter sections being in contact with said glue and with one of said filter sections being free of said glue, and thereafter moving said filter section being free of glue towards said charge of particulate filter material and said filter section being in contact with said glue to compact the charge of particulate material.

2. A method as set forth in claim 1 wherein the alternate filter sections are of different length.

3. A method as set forth in claim 1 wherein the filter sections are made of fibrous entrainment-type filter material.

4. A method as set forth in claim 1 wherein the filter sections are spaced apart at equal spacings.

5. In a method of forming a multi-sectional filter, the steps of moving a stream of plug wrap paper through a predetermined path;

placing increments of glue on one side of the stream of plug wrap paper at predetermined spacings from each other;

moving a sequence of filter sections onto the stream of plug wrap paper with alternate filter sections being disposed on the increments of glue;

thereafter wrapping the stream of plug wrap paper about the filter sections to form an endless rod;

severing the rod into filter plugs of predetermined length, each filter plug having two outer filter sections and one intermediate filter section within a strip of plug wrap paper and with the intermediate filter section glued to the strip of plug wrap paper by means of said increment of glue and said two outer filter sections being free of said glue;

joining each filter plug to a tobacco column at each end; and then severing each filter plug in half through the intermediate filter section to form two filter cigarettes each having a glued filter section at an exposed end of the cigarette and an unglued filter section at the tobacco column end.

6. In a method as set forth in claim 5 wherein the alternate filter sections are of different length.

7. A method of forming a multi-sectional particulate-containing filter, said method comprising the steps of moving a stream of plug wrap paper through a predetermined path;

placing increments of glue on one side of the stream of plug wrap paper at predetermined spacings from each other;

moving a sequence of spaced apart filter sections onto the moving stream of plug wrap paper with alternate filter sections being disposed on the increments of glue;

subsequently depositing charges of particulate filter material onto the moving stream of plug wrap paper between adjacent filter sections;

thereafter wrapping the moving stream of plug wrap paper about the filter sections and charges of particulate filter material to form an endless rod;

severing the endless rod into filter plugs of predetermined length, each filter plug having two outer filter sections and one intermediate filter section and two charges of particulate filter material within a strip of plug wrap paper, said intermediate filter section being glued to the strip at plug wrap paper by means of said increment of glue and sand two outer filter sections being free of said glue; and thereafter moving said two outer filter sections of each filter plug inwardly towards the intermediate filter section to compact the charges of particulate filter material therebetween.

8. A method as set forth in claim 7 which further comprises the steps of joining each filter plug to a tobacco column at each end and then severing each filter plug in half through the intermediate filter section to form two cigarettes, each cigarette having a glued filter section at an exposed end, an unglued filter section at the opposite tobacco column end and a compacted charge of particulate filter material therebetween.

* * * * *